US008911210B2

(12) United States Patent
Bilz et al.

(10) Patent No.: US 8,911,210 B2
(45) Date of Patent: Dec. 16, 2014

(54) VIBRATION-DAMPING SHIM FOR FAN BLADE

(75) Inventors: Laurent Bilz, Vaux le Penil (FR); Fabrice Marois, Hericy (FR); Patrick Jean-Louis Reghezza, Vaux le Penil (FR); Julien Tran, Pontoise (FR)

(73) Assignee: SNECMA, Paris (FR)

( * ) Notice: Subject to any disclaimer, the term of this patent is extended or adjusted under 35 U.S.C. 154(b) by 525 days.

(21) Appl. No.: 13/388,697

(22) PCT Filed: Aug. 9, 2010

(86) PCT No.: PCT/EP2010/061534

§ 371 (c)(1),
(2), (4) Date: Feb. 3, 2012

(87) PCT Pub. No.: WO2011/018425

PCT Pub. Date: Feb. 17, 2011

(65) Prior Publication Data

US 2012/0141296 A1 Jun. 7, 2012

(30) Foreign Application Priority Data

Aug. 11, 2009 (FR) ..... 09 55625

(51) Int. Cl.

| | |
|---|---|
| ***F01D 5/26*** | (2006.01) |
| ***F01D 5/10*** | (2006.01) |
| ***F01D 5/22*** | (2006.01) |
| ***F01D 5/30*** | (2006.01) |
| ***F01D 5/32*** | (2006.01) |
| ***F01D 11/00*** | (2006.01) |
| ***F01D 25/04*** | (2006.01) |

(52) U.S. Cl.

CPC .. *F01D 5/10* (2013.01); *F01D 5/22* (2013.01); *F01D 5/26* (2013.01); *F01D 5/3053* (2013.01); *F01D 5/323* (2013.01); *F01D 5/326* (2013.01); *F01D 11/006* (2013.01); *F01D 25/04* (2013.01); *F05D 2240/80* (2013.01); *F05D 2260/30* (2013.01); *Y10S 416/50* (2013.01)

USPC ..... 416/193 A; 416/500

(58) Field of Classification Search

CPC ..... F01D 5/16; F01D 5/26; F01D 25/06; F05D 2240/80

USPC ..... 416/190, 193 A, 500

See application file for complete search history.

(56) References Cited

U.S. PATENT DOCUMENTS 3,936,234 A 2/1976 Tucker et al.
4,265,595 A * 5/1981 Bucy et al. ..... 416/220 R (Continued)

FOREIGN PATENT DOCUMENTS

EP 0 081 416 A1 6/1983
EP 0 110 744 A1 6/1984

(Continued)

OTHER PUBLICATIONS

International Search Report issued Sep. 22, 2010 in International Application No. PCT/EP2010/061534.

*Primary Examiner* — Ninh H Nguyen

(74) *Attorney, Agent, or Firm* — Oblon, Spivak, McClelland, Maier & Neustadt, L.L.P.

(57) ABSTRACT

A vibration-damping shim configured to be interposed between a platform of a fan blade and a fan disk, including a radially external surface fitted with plates in contact with the fan blade platform, and a radially internal surface formed by an upstream surface, configured to be facing the disk, and a downstream surface separated from the upstream surface by a break in alignment. The upstream surface includes a zone protruding radially towards the interior, initiated at some distance from its upstream end.

7 Claims, 4 Drawing Sheets

(56) References Cited

U.S. PATENT DOCUMENTS

| | | | | |
|---|---|---|---|---|
| 4,478,554 | A | 10/1984 | Surdi | |
| 4,494,909 | A | 1/1985 | Forestier | |
| 5,205,713 | A | 4/1993 | Szpunar et al. | |
| 5,573,375 | A * | 11/1996 | Barcza | 416/193 A |
| 6,932,575 | B2 * | 8/2005 | Surace et al. | 416/193 A |
| 8,113,783 | B2 * | 2/2012 | Mace et al. | 416/190 |
| 2009/0123286 | A1 | 5/2009 | Mace et al. | |

FOREIGN PATENT DOCUMENTS

| | | |
|---|---|---|
| EP | 2 058 526 A1 | 5/2009 |
| GB | 2 038 959 A | 7/1980 |

* cited by examiner

VIBRATION-DAMPING SHIM FOR FAN BLADE

TECHNICAL FIELD

The present invention relates generally to a fan for an aircraft turbomachine, preferably for a turbojet. More specifically, the invention concerns the vibration-damping shims interposed between the platform of the blades and the fan disk.

STATE OF THE PRIOR ART

A fan 1 for a turbojet known from the prior art is shown in FIG. 1. It presents a disk 2 centred on a longitudinal axis 4, which is the rotational axis of the fan. Fan blades 6 are assembled on the periphery of the disk in conventional fashion, and regularly distributed around axis 4.

In addition, associated with each blade 6, vibration-damping shim 10 is interposed radially between platform 12 of the blade and the periphery of disk 2. Globally, this shim takes the form of an elastomer block 14 fitted with contact plates 16*a*, 16*b* designed to reduce the levels of vibration of the fan blades.

More specifically, shim 10 has a radially external surface 18 fitted with two plates 16*a*, 16*b* in contact with platform 12, together with a radially internal surface 20 formed by an upstream surface 22 facing disk 2 and a downstream surface 24 separated from the upstream surface by a break in alignment or level 26. With this regard, in all the following description, the terms "upstream" and "downstream" must be considered relative to the direction of thrust generated by the fan, represented diagrammatically by arrow 5.

On the radially internal surface 20, upstream surface 22 is located radially towards the interior relative to downstream surface 24. Upstream surface 22 is centred on a transverse median plane of disk 2 opposite which it is located. Conversely, downstream surface 24 is located radially perpendicular to and facing an attaching flange 28 forming a single piece with the disk, and protruding radially towards the exterior. This flange 28 allows the assembly by bolting of an axial end shim 30 preventing vibration-damping shim 10 from escaping towards the rear. With this regard, it is noted that shim 30 has a radially external skirt 32 against which presses an axial stop plate 34 positioned on shim 10, in the area of the radially upper part of its downstream end surface 36. As is clearly shown in FIG. 1, end plate 34 is also extended over downstream surface 24, thus acquiring a section in the shape of an inverted L. As with contact plates 16*a*, 16*b*, the stop plate is preferentially made of metal.

In addition, each flange 28 is designed to form a single piece with a radial tooth 23 of disk 2, where these teeth 23 are spaced circumferentially relative to one another, and define, between one another, recesses intended to house the bases of blades 6.

In the break in alignment 26 of shim 10, considered as constituting the radially internal part of the downstream end surface 36, there are one or more recesses of matter 40, which are open axially, and each of which houses a portion of a bolt 42 used for the assembly of stop shim 30 on flange 28.

In addition, it is noted that break in alignment 26, which is comparable to a surface radially aligned facing downstream, constitutes a demarcation either side of which are located, respectively, upstream plate 16*a* in contact with the platform, and downstream plate 16*b* in contact with this same platform.

Lastly, it is noted that upstream and downstream surfaces 22, 24 are each roughly flat, or slightly convex towards the interior to follow the profile of disk 2. With this regard, each shim 10 can extend over an angular sector of only several degrees.

During normal operation of the fan the centrifugal efforts enable damping shim 20 to be pressed on the underneath of platform 12 of blade 6, as shown in FIG. 1. The restitution of the centrifugal force by the contact of plates 16*a*, 16*b* with the corresponding portions of the platform enables the blade's vibratory levels to be reduced.

Conversely, in autorotation mode due to wind (windmilling), the fact that this centrifugal force is almost non-existent, combined with the tipping of blade 6 towards the upstream of the rotor, increases the space between platform 12 and the periphery of the disk, which may lead to an undesired movement of shim 10. Such a movement is represented diagrammatically in FIG. 2, showing as a tipping forward of damping shim 10, and therefore a reduction of the initial clearance between upstream end 22*a* of upstream surface 22 and the periphery of disk 2, in this case constituted by the radially external surface 23*a* of tooth 23 opposite which shim 10 is positioned.

The poor position held by shim 10 can lead to premature wear and tear and also such wear and tear of the parts in contact. More specifically, the habitual consequence of the forward tipping of shim 10 is a loss of contact between axial stop plate 34 and its associated stop shim 30, and a loss of contact between upstream contact plate 16*a* and its associated portion of the platform. A contact of very substantial intensity then exists between downstream contact plate 16*b* and its associated portion of the platform, and also between upstream end or ridge 22*a* of upstream surface 22 and disk 2, the consequence of which being the risks of premature wear and tear mentioned above.

SUMMARY OF THE INVENTION

The purpose of the invention is therefore to provide at least partially a solution to the disadvantages mentioned above, compared with the embodiments of the prior art.

To accomplish this, the object of the invention is a vibration-damping shim intended to be interposed between a fan blade platform and a fan disk, where said shim has a radially external surface fitted with at least one plate in contact with the fan blade platform, and a radially internal surface formed by an upstream surface, intended to be facing said disk, and a downstream surface separated from the upstream surface by a break in alignment, where said upstream surface is located radially towards the interior relative to said downstream surface. According to the invention, said upstream surface has a zone protruding radially towards the interior, initiated at some distance from its upstream end.

The presence of this protruding zone enables the tipping amplitude of the shim described above to be restricted, since this zone is located as close as possible to the periphery of the disk against which it is capable of being stopped, when an insufficient centrifugal force does not enable the radially external surface of the damping shim to be pressed against the platform. In addition, this restriction of the tipping amplitude of the shim results from the downstream positioning of the protruding zone.

The restriction of the tipping of the shim notably enables contact between the axial stop plate and its associated stop shim to be maintained.

In addition, when contact occurs between the upstream ridge of the protruding zone and the disk, after the shim tips forward to a limited extent, this ridge has a low angle, limiting its wear and tear. Indeed, this low angle is synonymous with a substantial contact surface between the ridge and the disk, limiting the risks of premature wear and tear of the shim.

In addition, it is noted that the position of the protruding zone, at some distance from the upstream end of the upstream surface and upstream from the break in alignment, enables the shim not to become completely unbalanced, which means that its centre of gravity can be in the same area as in the damping shims of the prior art with a roughly flat upstream surface.

The damping shim preferably includes an upstream plate in contact with the fan blade platform, and a downstream plate in contact with the fan blade platform, positioned respectively upstream and downstream relative to said break in alignment.

Said protruding zone is preferably located radially perpendicular to said upstream contact plate.

The damping shim preferably includes a downstream end surface, a radially higher portion of which is fitted with an axial stop plate.

Said protruding zone preferably extends axially over approximately 40 to 70% of said upstream surface of the radially internal surface.

Said break in alignment preferably includes one or more recesses of matter open axially in a downstream direction.

Another object of the invention is a fan for an aircraft turbomachine including a fan disk and multiple fan blades assembled on the disk, where each blade has a platform and at least one vibration-damping shim as described above, interposed between said platform and the disk. A single vibration-damping shim is preferably positioned under a given fan blade.

Other advantages and characteristics of the invention will appear in the non-restrictive detailed disclosure below.

BRIEF DESCRIPTION OF THE DRAWINGS

This description will be made with reference to the attached illustrations, among which.

DETAILED DESCRIPTION OF PREFERRED EMBODIMENTS

Figure 1:
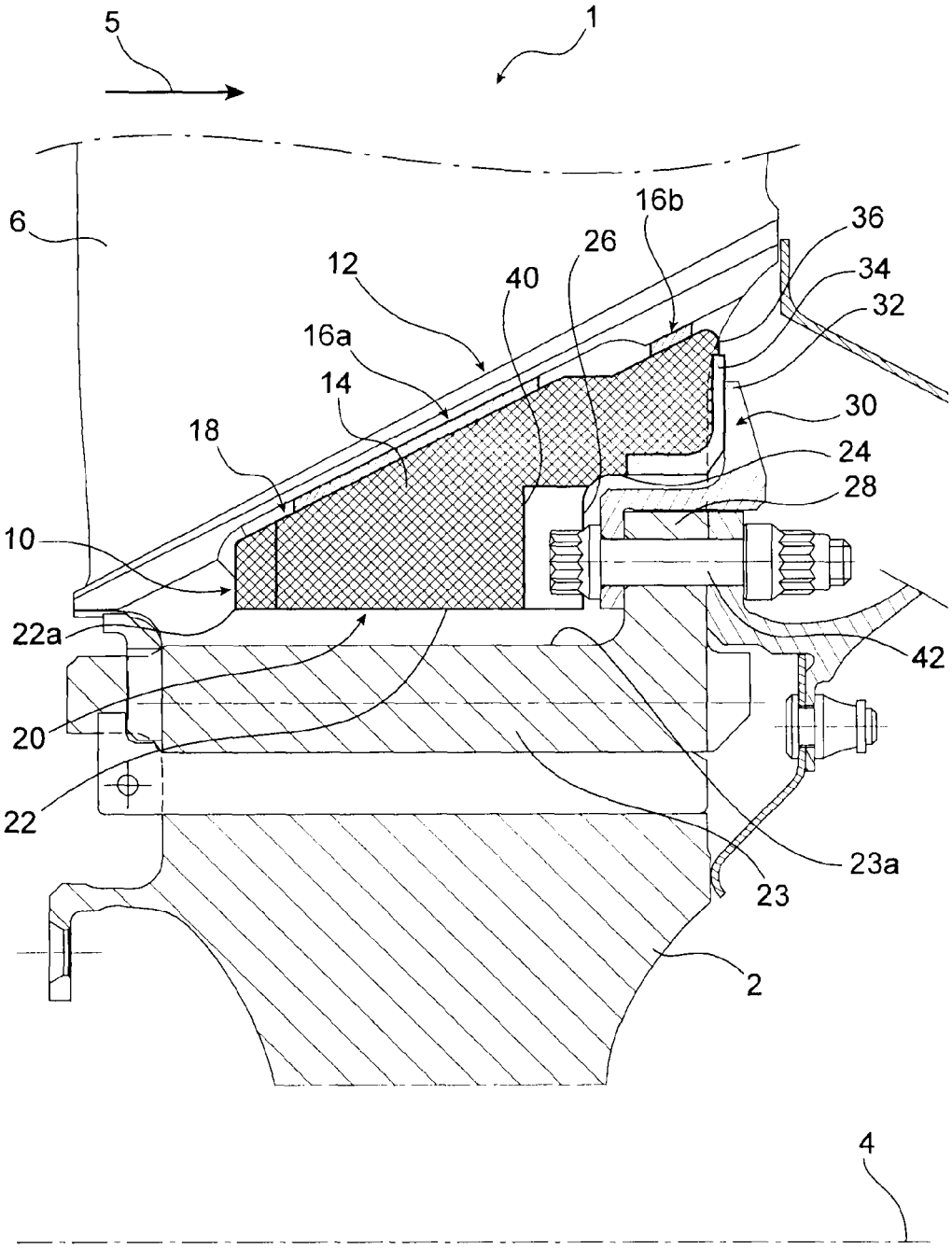
FIGS. 1 and 2, previously described, represent a fan of an aircraft turbojet known from the prior art.
Figure 2:
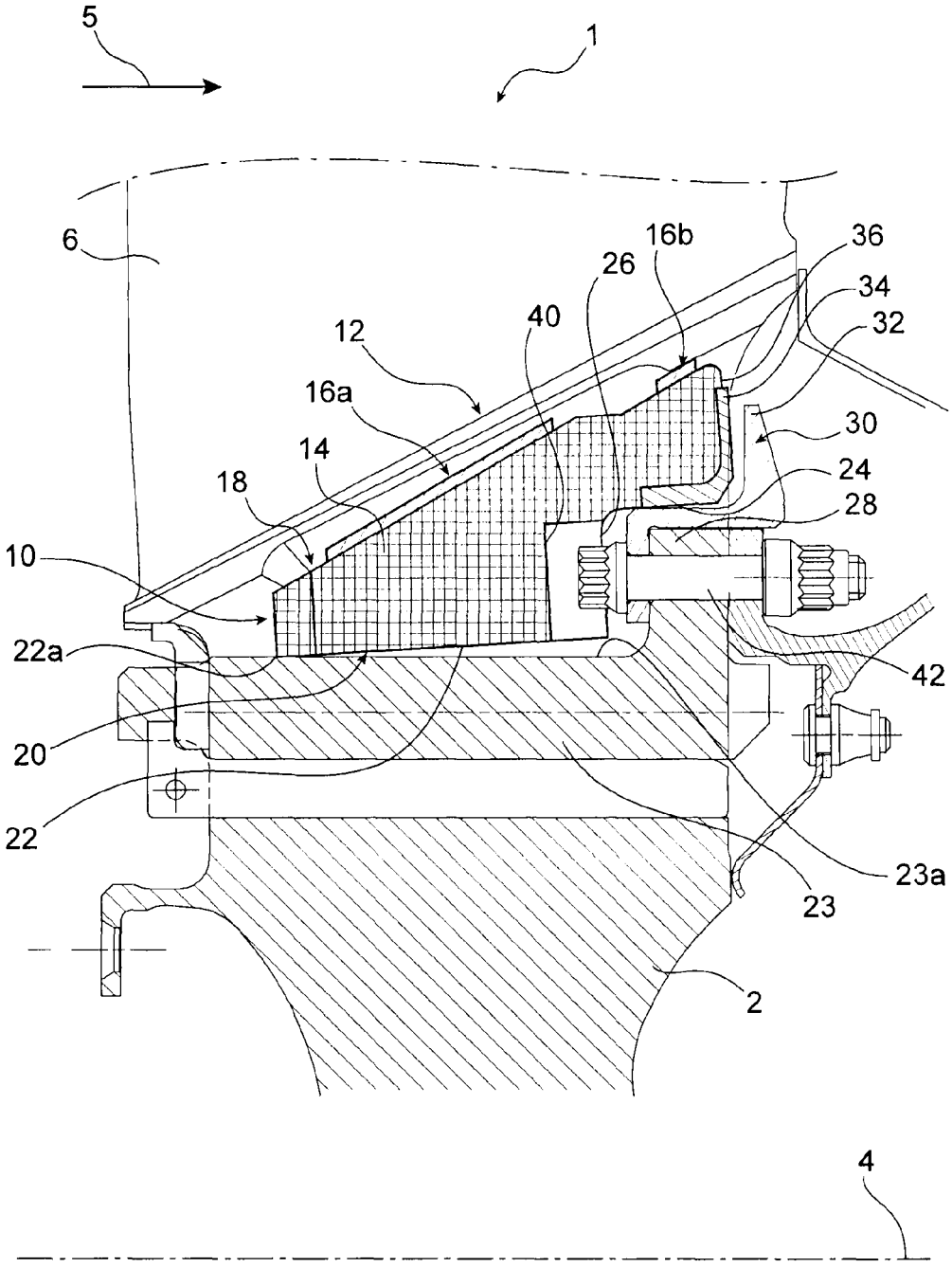
Figure 3:
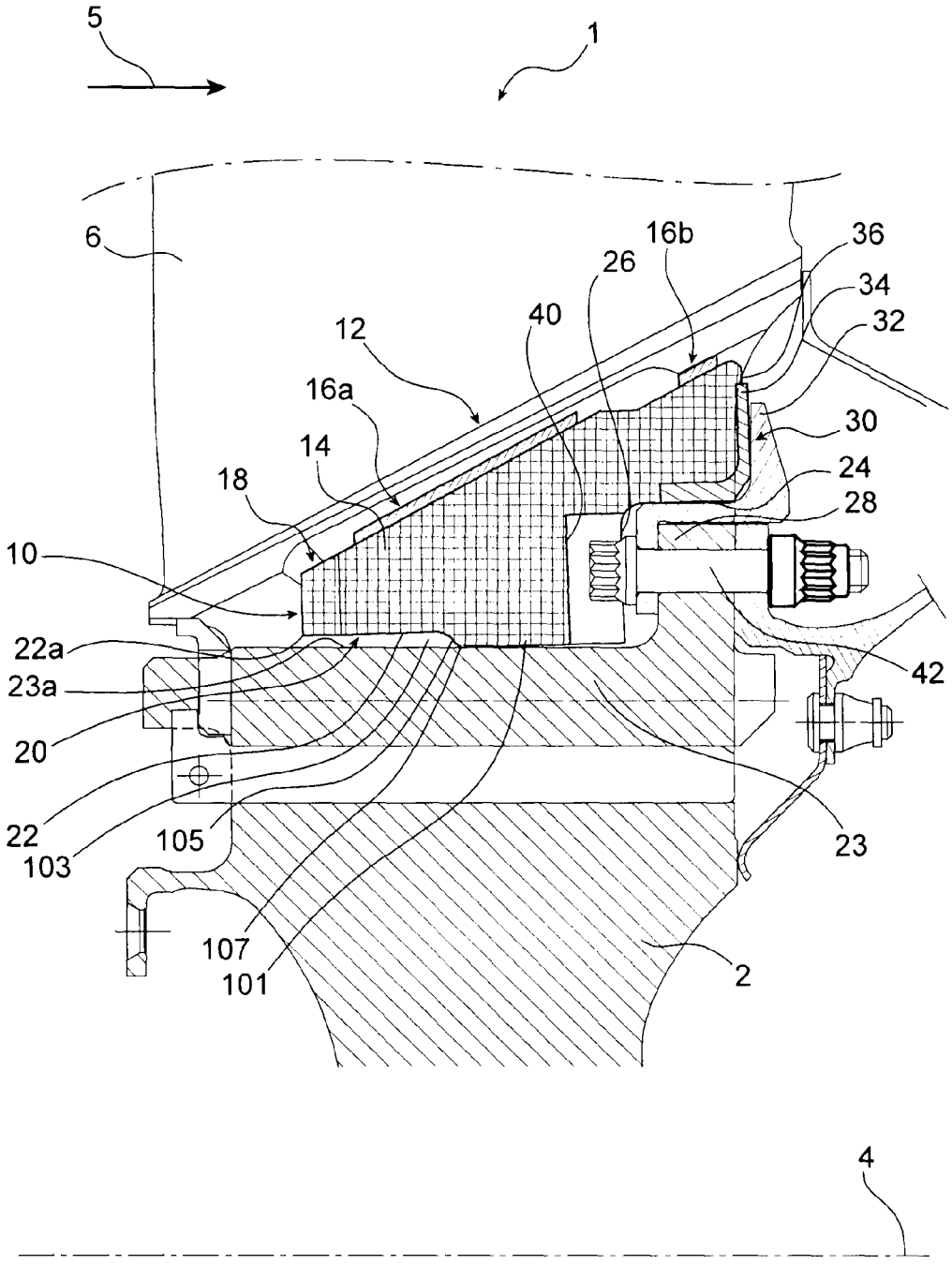
FIG. 3 represents a fan of an aircraft turbojet according to a preferred embodiment of the present invention.
Figure 4:
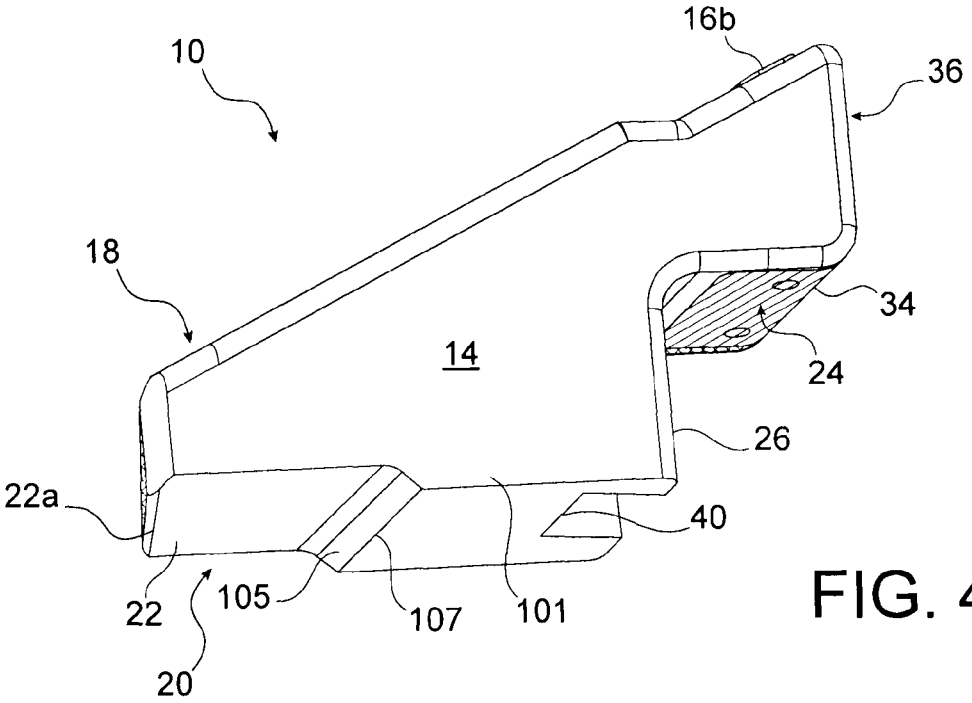
FIGS. 4 and 5 represent two perspective views of the vibration-damping shim fitted to the fan of FIG. 3, from two different perspectives.
Figure 5:
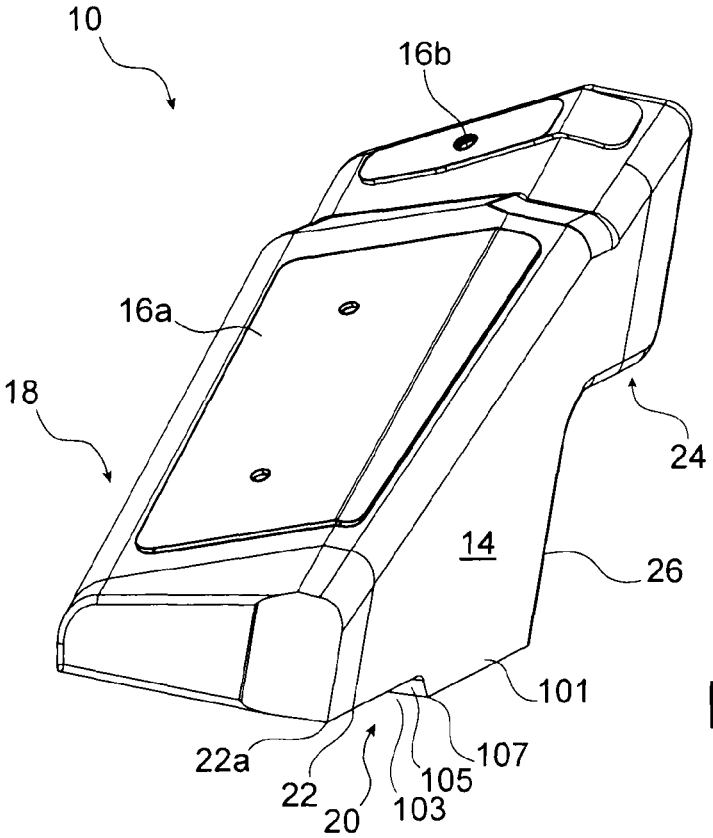

With reference to FIGS. 3 and 4, a fan 1 of an aircraft turbojet according to a preferred embodiment of the present invention can be seen. This fan differs from the one described with reference to FIGS. 1 and 2 only through the shape of upstream surface 22 of vibration-damping shim 10. Moreover, in the figures, the elements bearing the same numerical references are identical or similar elements.

Thus, upstream surface 22 positioned upstream from break in alignment 26 is no longer flat or slightly convex as in the prior art, but has a zone 101 protruding radially towards the interior, initiated at some distance from its upstream end 22*a*.

Consequently, upstream surface 22 of radially internal surface 20 starts by a recess 103 initiated from upstream end or ridge 22*a*, and then encounters a break in alignment 105 radially aligned towards the interior, which initiates protruding zone 101. The latter is extended downstream as far as break in alignment 26.

Recess 103 and protruding zone 101 each have a roughly flat surface opposite disk 2, or a surface which is slightly convex towards the interior, to follow the profile of this disk. They are therefore each extended uniformly along the circumferential direction of the shim, at different distances from disk 2, zone 101 being the closer of the two. Protruding zone 101 preferably extends axially over approximately to 70% of upstream surface 22, and is located perpendicular, in the radial direction, to upstream contact plate 16*a*.

As shown in FIG. 3, when contact occurs between upstream ridge 107 of protruding zone 101 and the periphery of disk 2 constituted by external radial surface 23*a* of tooth 23, following a limited forward tipping of shim 10, this ridge 107 has a low angle, limiting its wear and tear. In addition, again in this same situation encountered when an insufficient centrifugal force does not enable the radially external surface 18 of shim 10 to be pressed against platform 12, the limitation of the tipping of shim 10 also enables contact to be maintained between axial stop plate 34 and its stop shim 30.

Again in this configuration represented diagrammatically in FIG. 3, no contact is created between upstream end 22*a* of upstream surface 22 and radial external surface 23*a* of tooth 23, such that no premature wear and tear can occur at this specific location of elastomer block 14.

Naturally, various modifications can be made by the skilled man in the art to the invention which has just been described, solely as non-restrictive examples.

The invention claimed is:

1. A vibration-damping shim configured to be interposed between a platform of a fan blade and a fan disk, comprising:

a radially external surface fitted with at least one plate in contact with the fan blade platform; and a radially internal surface formed by an upstream surface, configured to be facing the disk, and a downstream surface separated from the upstream surface by a break in alignment, wherein the upstream surface is located radially towards the interior relative to the downstream surface, wherein the upstream surface includes a zone protruding radially towards the interior, initiated at a distance from its upstream end.

2. A damping shim according to claim 1, further comprising an upstream plate in contact with the fan blade platform, and a downstream plate in contact with the fan blade platform, positioned respectively upstream and downstream relative to the break in alignment.

3. A damping shim according to claim 2, wherein the protruding zone is located radially perpendicular to the upstream contact plate.

4. A damping shim according to claim 1, further comprising a downstream end surface including a radially higher portion fitted with an axial stop plate.

5. A damping shim according to claim 1, wherein the protruding zone extends axially over approximately 40% to 70% of the upstream surface of the radially internal surface.

6. A damping shim according to claim 1, wherein the break in alignment includes one or more recesses of matter open axially in a downstream direction.

7. A fan for an aircraft turbomachine comprising:

a fan disk; and multiple fan blades assembled on the disk, wherein each blade includes a platform and at least one vibration-damping shim according to claim 1, interposed between the platform and the disk.

* * * * *